US008919908B2

(12) United States Patent
Silveston-Keith et al.

(10) Patent No.: US 8,919,908 B2
(45) Date of Patent: Dec. 30, 2014

(54) INK SMEAR MEASUREMENT IN AN IMAGING APPARATUS

(71) Applicant: Funai Electric Co., Ltd., Daito (JP)

(72) Inventors: Rebecca Beth Silveston-Keith, Lexington, KY (US); John Thomas Writt, Lexington, KY (US)

(73) Assignee: Funai Electric Co., Ltd. (JP)

( * ) Notice: Subject to any disclaimer, the term of this patent is extended or adjusted under 35 U.S.C. 154(b) by 106 days.

(21) Appl. No.: 13/719,934

(22) Filed: Dec. 19, 2012

(65) Prior Publication Data

US 2014/0168307 A1 Jun. 19, 2014

(51) Int. Cl.
*B41J 29/38* (2006.01)
*B41J 29/393* (2006.01)
*B41J 11/00* (2006.01)

(52) U.S. Cl.
CPC ..... *B41J 11/009* (2013.01); *B41J 2029/3935* (2013.01)
USPC ..... 347/16; 347/19

(58) Field of Classification Search
CPC . B41J 29/393; B41J 11/009; B41J 2029/3935
USPC ..... 347/16, 19, 101, 104
See application file for complete search history.

(56) References Cited

U.S. PATENT DOCUMENTS

2010/0277537 A1* 11/2010 Maekawara et al. ..... 347/16
2012/0045262 A1* 2/2012 Yoshida et al. ..... 399/340

* cited by examiner

*Primary Examiner* — Jannelle M Lebron
(74) *Attorney, Agent, or Firm* — Amster, Rothstein Ebenstein LLP

(57) ABSTRACT

A system implementing a method for determining smear tendency of a sheet of print media to reduce smearing on future media sheets of a similar type. The method includes creating an image on the sheet of print media. The sheet of print media is reversed to allow at least one upstream roller to contact and smear the image and create smear marks on the sheet of print media. Reference marks are created over the smear marks and at unsmeared areas of the sheet of print media. To determine the smear tendency, the reference marks over the smear marks are compared to the reference marks at the unsmeared areas. The smear tendency indicates future corrections to an imaging device to reduce smearing on the future media sheets when used by the imaging device.

5 Claims, 9 Drawing Sheets

INK SMEAR MEASUREMENT IN AN IMAGING APPARATUS

FIELD OF THE INVENTION

The present invention relates to micro-fluid applications, such as inkjet printing. More particularly, it relates to measuring ink smear tendency of media sheets in an inkjet printer.

BACKGROUND

The art of printing images with micro-fluid technology is relatively well known. Inkjet printing devices utilize consumable inkjet cartridges or ink tanks in fluid communication with a permanent or semi-permanent ejection head, also known as printhead, to record text and images on a print media. The printhead typically moves on a carriage relative to the media path and a control system activates the printhead to selectively eject ink droplets onto the print media in a pattern of pixels corresponding to images being printed.

When images are printed on the print media, ink typically requires a length of time to dry, known as dry time. When inkjet printed images are contacted by another surface before the ink dry time expires, i.e., the ink is still wet on the surface of the media being printed on, smearing can occur. For example, when a first printed media is disposed on a media output area after a printing operation and a subsequent printed media is disposed on top of the first media while ink on the first media is not yet dry, ink on the first media may smear and/or some portion of the ink may transfer to the back of the subsequent media. In another example, smearing may occur during a duplex printing operation when rollers located along the media path engage images printed on a first side of the print media as the media is brought back into the printer to print images on its second side while the ink on the first side is not yet dry. Ink left on the rollers may also transfer to the second side or to media sheets used in subsequent printing operations, further causing print defects. As is evident, smearing compromises print quality.

Different approaches have been adapted to eliminate or at least mitigate ink smear problems. In some methods, inks are formulated with additives that reduce dry time and/or make them more resistant to smear. In other methods, the type of media is determined prior to printing so that the printer can properly set printing parameters according to the indicated type of media so as to optimize printer performance. These methods, however, have drawbacks in terms of reliability. For example, certain types of ink formulation have poor fixation properties for certain types of recording media which results in at least some level of ink smear problems. Meanwhile, knowing the type of media in advance may not be reliable at all times as there is still variability even in smear tendency between lot numbers of the same type of recording media.

Accordingly, a need exists in the art to more effectively determine smear tendency of a recording media. Further needs contemplate a printing system which performs actual measurement on a recording media for use in printing. Additional benefits and alternatives are also sought when devising solutions.

SUMMARY

The above-mentioned and other problems become solved by configuring an imaging device to measure ink smear tendency of a media sheet of interest via a sequence of printing and measuring patterns. By knowing the smear tendency of the media sheet, printer settings such as dry time, ink density, and printing speed can be adjusted to optimal settings to reduce smearing on future media sheets of a similar type as the tested media sheet when such future media sheets are used for printing by the imaging device.

In an example embodiment, the imaging device creates an image on the sheet of print media and intentionally smears them to create smear marks on the media sheet. In an example aspect, the sheet of print media is reversed to allow at least one upstream roller to contact and smear the image and create the smear marks on the sheet of print media. Reference marks are then printed over the smear marks and at unsmeared areas of the sheet of print media. Thereafter, the reference marks over the smear marks are compared to the reference marks at the unsmeared areas to determine the smear tendency of the sheet of print media. The smear tendency indicates future corrections to the imaging device when printing on future media sheets of a similar type as the sheet of print media to reduce smearing on such future media sheets.

Further embodiments contemplate repetition of the processes described above but with differing amounts of waiting time before smearing printed patterns after they are printed on the media sheet. Each waiting time defines a time period that allows an image pattern to partially dry on the media sheet to a point that would still allow smearing when contacted by other surfaces. For each waiting time, different values corresponding to the smear tendency of the sheet of print media are determined. Taking into consideration the different waiting times and respective values obtained, the imaging device performs calculations to determine an optimal dry time. The imaging device then uses the optimal dry time to adjust various printing parameters when printing on the future media sheets of similar type as the tested media sheet.

These and other embodiments are set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, an imaging device performs actual measurements on a media sheet of interest to determine smear tendency associated with the media sheet. When printing on future sheets of print media having a similar type to that of the tested media sheet, the imaging device is adjusted based on the smear tendency such that the future sheets of print media are printed with reduced smearing, thereby improving print quality.

Figure 1:
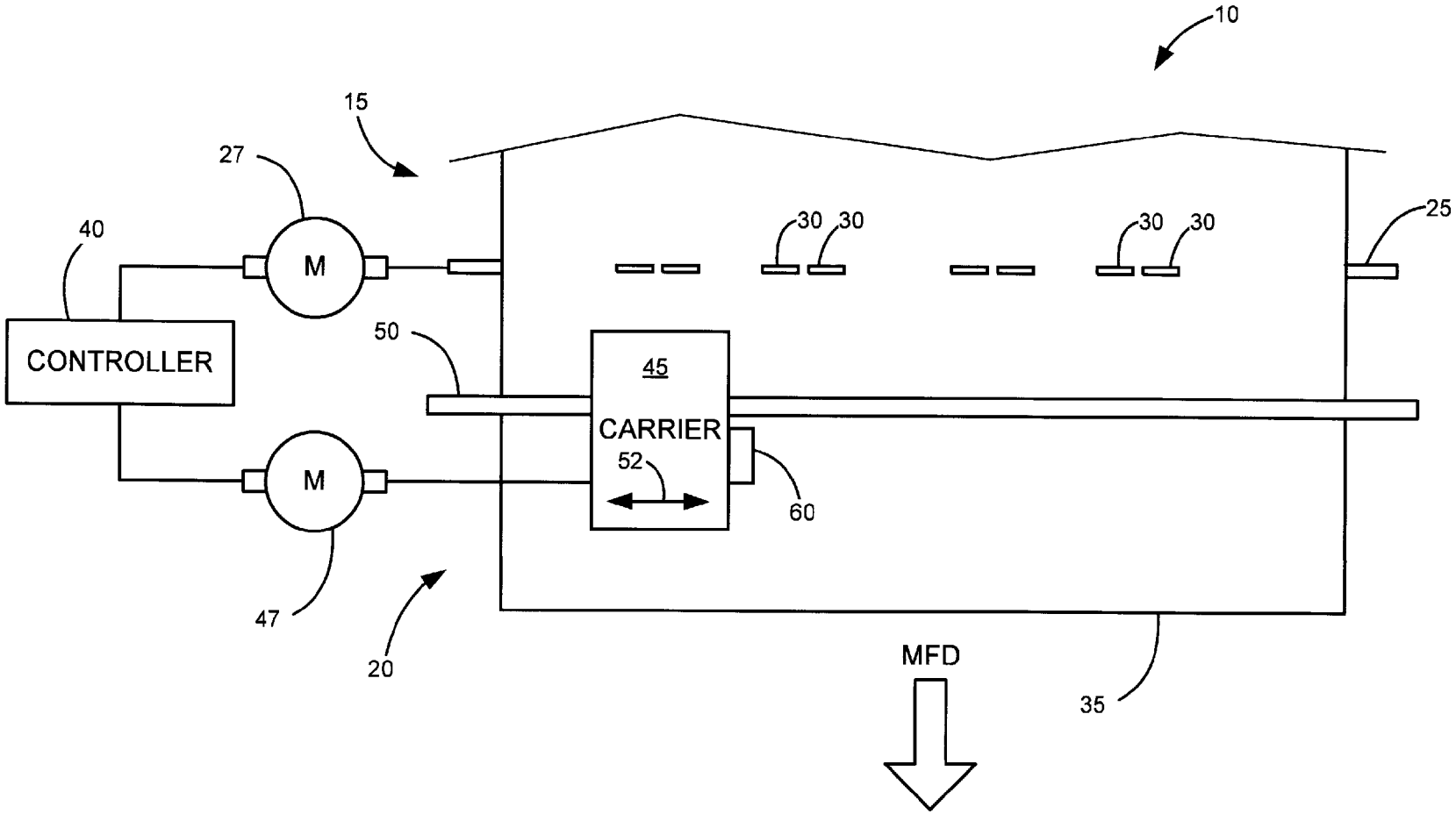
FIG. 1 is a schematic plan view in accordance with the present invention of an imaging device having a media indexing assembly and a printhead assembly.

With reference to FIG. 1, a system 10 for use in an imaging device includes a media indexing assembly 15 and a printhead assembly 20. Media indexing assembly 15 includes a feedroller 25 driven by a motor 27, and pressure rollers 30 positioned to engage feedroller 25 to form a nip therewith. A sheet of print media 35 can be fed into the nip, whereby media 35 is placed in contact with feedroller 25 by the pressure rollers 30 to allow media 35 to be driven by the outer surface of feedroller 25. At a directive of a controller 40, motor 27 rotates feedroller 25 to advance media 35 in a media feed direction indicated by arrow MFD, or in a reverse direction relative to the media feed direction MFD.

Printhead assembly 20 includes a carrier 45 mounting one or more disposable or (semi) permanent printheads (not shown). The printheads may have access to a local or a remote supply of ink. Carrier 45 is arranged to be driven by a motor 47 along a shaft 50 that defines a bi-directional scanning path 52. At a directive of controller 40, motor 47 moves carrier 45 in a controlled manner along bidirectional scanning path 52. In a printing operation, controller 40 controls the movement of carrier 45 so as to cause carrier 45 to transport the printheads across media 35 in a reciprocating manner along shaft 50. Alternate embodiments also contemplate a page wide printhead array needing no motors or scanning of a movable carriage across a media sheet.

Carrier 45 also mounts a sensor 60 for sensing printed marks on media 35. Sensor 60 may comprise an automatic alignment sensor normally used to read patterns on a calibration media for optimizing various printer parameters. In one example, sensor 60 includes an optical sensor having a source of optical radiation, such as a light emitting diode, and a detector, such as a photodetector, for detecting radiation provided by the source and reflected from the media 35. Sensor 60 provides outputs at the detector which correspond to amounts of radiation reflected from media 35. Such outputs are also provided to controller 40 for analysis.

In accordance with example embodiments of the present invention, the imaging device is operable to obtain actual measurements of ink smear tendency of media sheets of interest. In certain embodiments, methods contemplate use of system 10 to perform a sequence of printing, smearing, and measuring of patterns of indicia on a media sheet of interest to determine smear tendency of the media sheet. The smear tendency is represented by a value or a smear score obtained from measurements and which is used to adjust various printing parameters. Such measurements are done to enable the imaging device to more accurately apply print parameters, such as for example ink density and printing speed, which are most suitable for the particular type of media to be used, instead of simply applying default print settings based on user-identified media type.

Measurements can take place in various instances. For example, a user can be prompted with the option to measure smear tendency of a media when new media is introduced in a media tray. Alternatively, the imaging device may be configured to automatically perform measurement when a new stack of media sheets is disposed in the media tray. In this example, the imaging device may take one sheet of the stack as a sacrificial sheet to be used for measurement. In another example, the user may operate the imaging device to conduct measurements at any desired time, such as when the user experiences smearing issues. In still other examples, measurements can be done along with other printer functions, such as during printhead alignment and other calibration processes.

Figure 2:
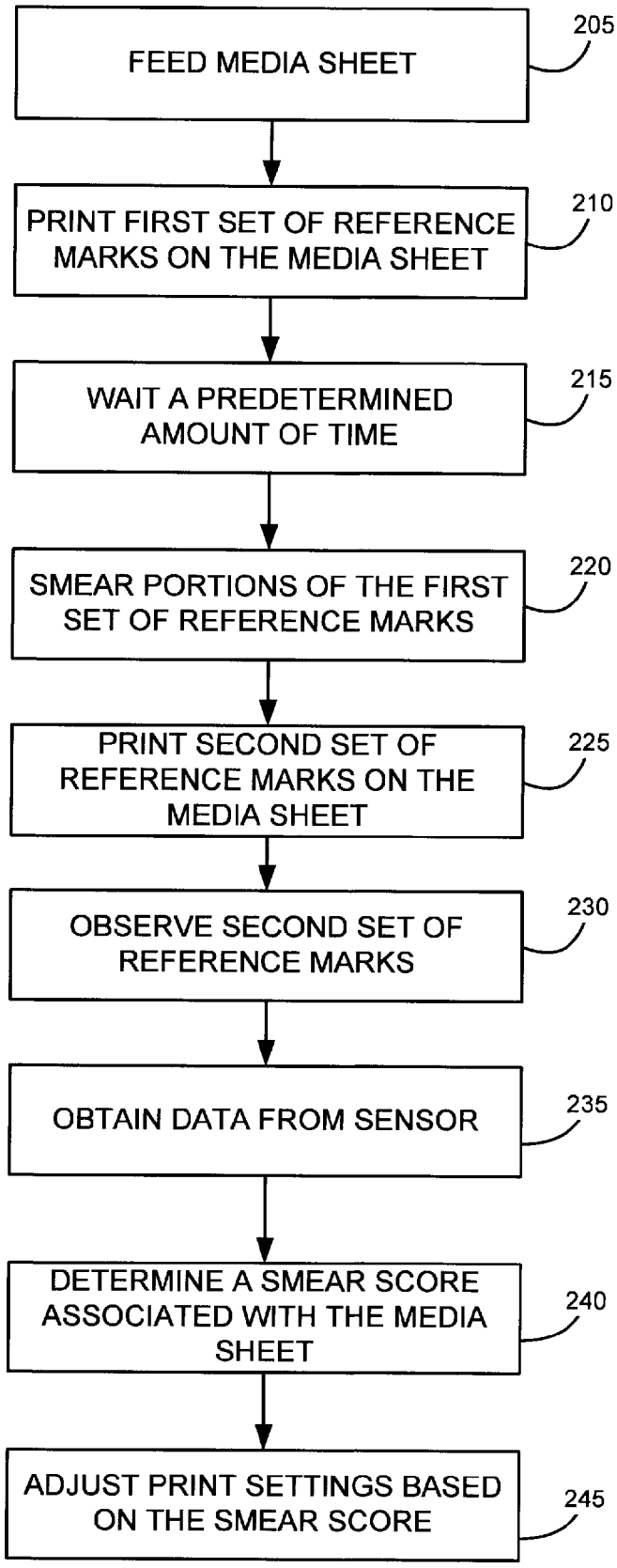
FIG. 2 is a flowchart in accordance with the present invention illustrating an example method for ink smear measurement.

With reference to FIGS. 2-7, determining smear tendency of a media sheet using system 10 of the imaging device will now be described in more detail by way of example. FIG. 2 is a flowchart illustrating an example process while FIGS. 3-7 illustrate a sequence of events corresponding to the flowchart in FIG. 2.

Figure 3:
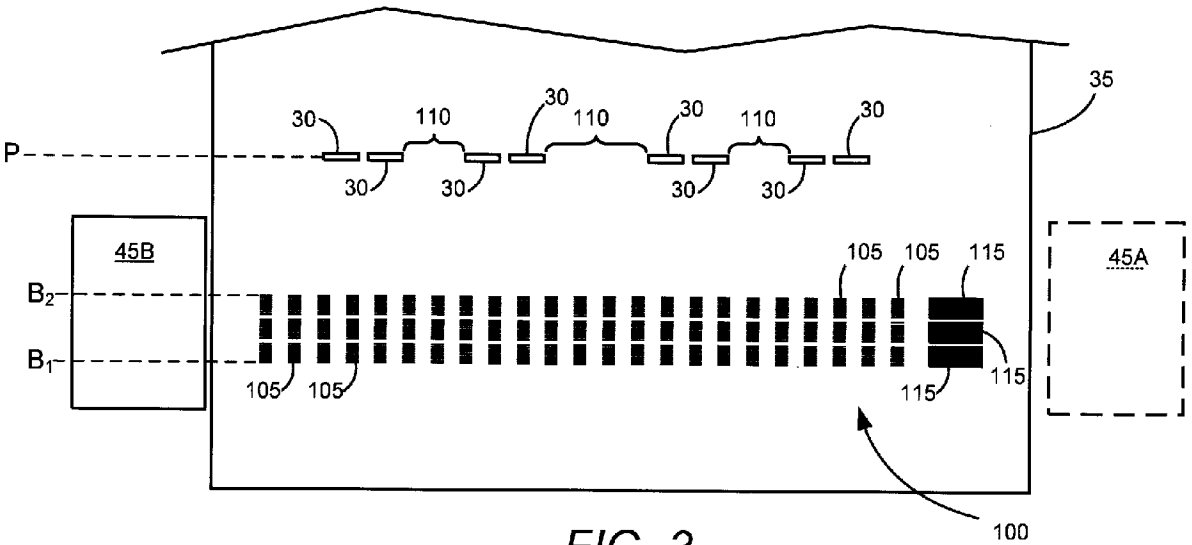
FIGS. 3-7 are schematic plan views illustrating a sequence for ink smear measurement in accordance with the example flowchart shown in FIG. 2 using the imaging device in FIG. 1.

The sequence starts at 205 with media sheet 35 to be measured being fed through the imaging device by media indexing assembly 15 moving media sheet 35 at a desired position for a printing operation adjacent carrier 45, as shown in FIG. 3. Once media sheet 35 is in position, carrier 45 is swept across the media sheet from position 45A to position 45B to make a first swath to print a first pattern of reference marks 100 on media sheet 35 at 210.

In this example, reference marks 100 comprise a plurality of blocks 105 arranged in columns and rows. The placement of the blocks 105 can be provided such that components of the media indexing assembly 15 (or other surfaces which may contact the media sheet 35 during media movement along the media path) contact only some of the blocks 105 and not all. In this example, pressure rollers 30 are spaced apart from each other by a clearance area 110. The plurality of blocks 105 extend across the width of media sheet 35 such that some of the blocks 105 are contacted by the pressure rollers while others that pass through the clearance areas 110 are not engaged when media sheet 35 is moved, for example, in a reverse direction relative to the media feed direction MFD. This configuration allows smear marks to appear at some areas on the media sheet 35 while leaving some other areas unsmeared for future comparison steps later described below.

The blocks 105 are appropriately sized for the viewing area of sensor 60 and are sufficiently dark (with sufficient amount of ink) to allow them to intentionally smear when contacted by other surfaces. There may be some instances, however, where pressure exerted by rollers on the dark blocks 105, when contacted by the rollers, cause ink to squeeze out to the edges of the blocks which may consequently affect measurement results. In order to reduce this "squeegee effect" between ink and rollers and for improved results, each of the blocks 105 may be printed to include a few horizontal white lines (unprinted portions), as shown in this example. Alternatively, the blocks 105 can be printed as solid areas of black or other color with no white lines therein. Additionally, purge bars 115 can also be printed at the start of the swath when printing the reference marks 100 to ensure good printhead jetting.

Figure 4:
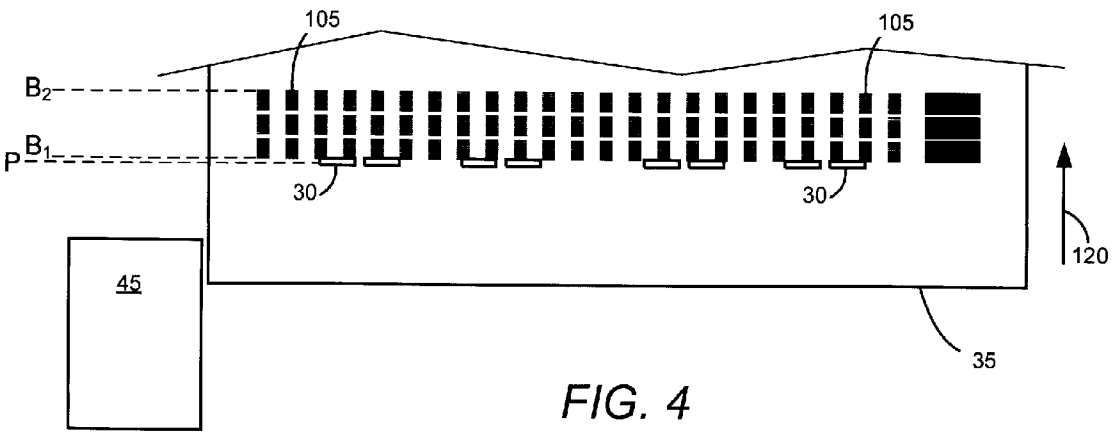

After printing the blocks 105, a predetermined amount of time is waited to elapse at 215 before moving media sheet 35 in the direction indicated by arrow 120 in FIG. 4. This amount of time defines a time interval that allows ink to partially dry, either by absorption into the media sheet, evaporation, or some other phase change. Once the time elapses, portions of the reference marks 100 are smeared at 220. Media sheet 35 is moved in the direction indicated by arrow 120 at least just enough for edge B1 of the reference marks 100 to go beyond the intermediate position P of the pressure rollers 30 within the imaging device. During this movement, fractions of the printed inks forming the blocks 105 are still liquid at the surface of the media sheet 35 such that some of the printed inks transfer onto the outer surfaces of the pressure rollers 30. In some example embodiments, the reverse action moves the media sheet along a duplex path. In such a case, the trailing edge of the media sheet needs to be past a duplex gate at the outset of the sequence at 205 to allow future reverse movement of the media sheet into the duplex path.

Figure 5:
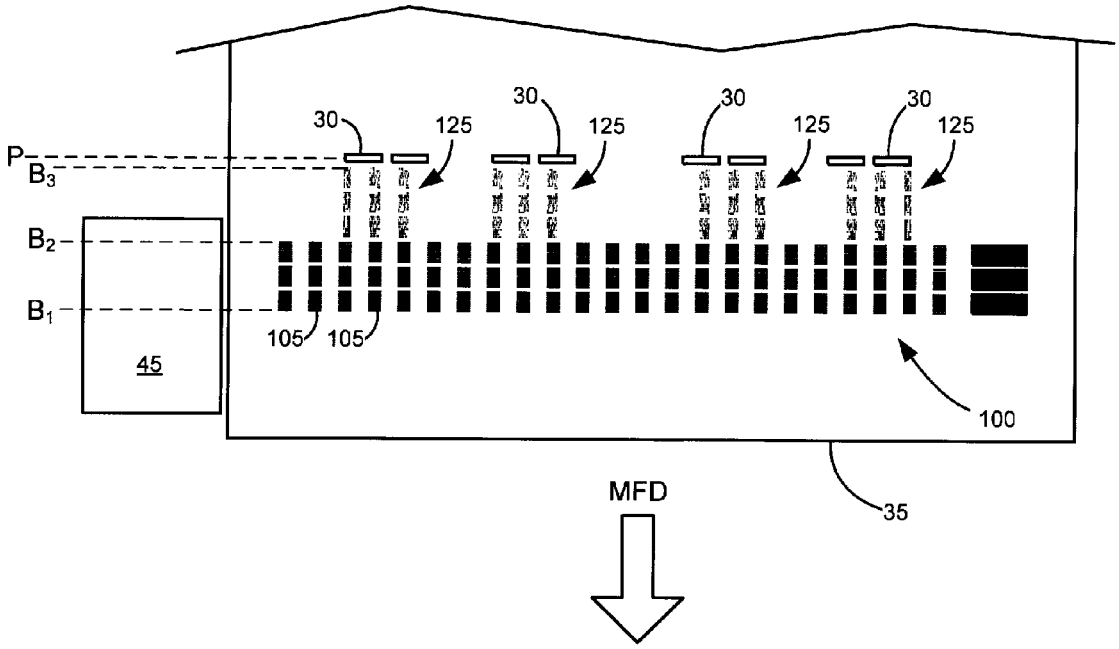

In FIG. 5, media sheet 35 is advanced in the media feed direction MFD in order to transfer the ink from the wet pressure rollers 30 to a clean area adjacent reference marks 100 on media sheet 35. This creates smear marks 125 between the pressure rollers 30 and the edge B2 of the reference marks 100. On the other hand, areas between smear marks 125 are left unsmeared. In one example, the media sheet 35 is advanced at least one pressure roller circumference in order for ink transferred on the circumferential surfaces of the pressure rollers 30 during the reverse move to be transferred back onto the media sheet 35 as smear marks 125. It will also be understood that media sheet 35 can be advanced by other distances depending on the size of rollers, so long as such movement is sufficient enough to transfer ink on the rollers back onto media sheet 35.

Figure 6:
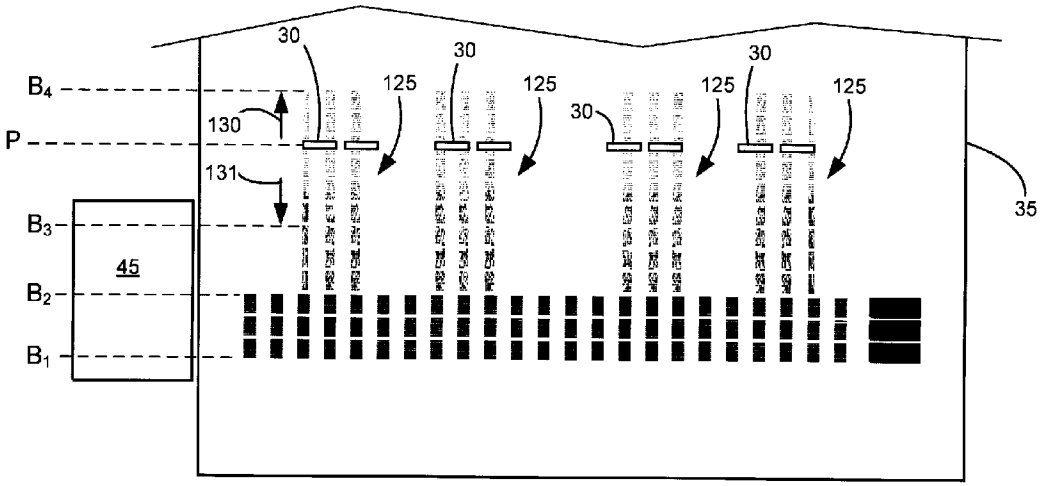

One complete rotation of the pressure rollers 30 may not be enough to completely remove all ink from the pressure rollers 30. As measurements are repeated continuously, ink may further accumulate on the pressure rollers 30 over time. To mitigate this effect, the pressure rollers 30 can optionally be automatically cleaned by continuing to advance media sheet 35 in the media feed direction MFD to allow remaining ink on the roller surfaces to be deposited between edges B3 and B4 on media sheet 35, as shown in FIG. 6. In addition, the media sheet 35 can be moved back and forth several times so that the pressure rollers 30 move against the media sheet 35 between edges B3 and B4, as indicated by arrows 130 and 131, wiping remaining ink on the pressure rollers 30 onto media sheet 35.

Figure 7:
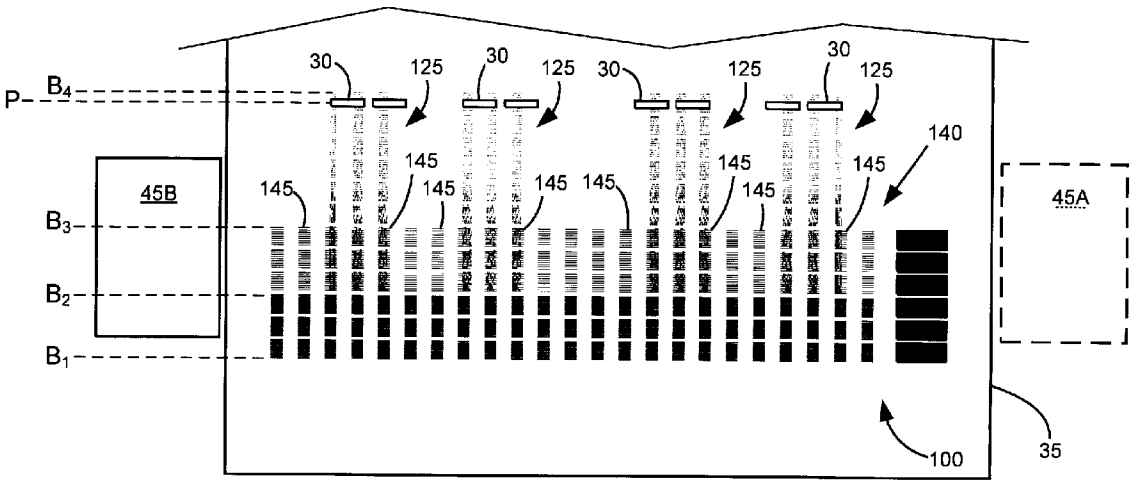

After the cleaning action, media sheet 35 is positioned for another printing operation with the smeared area (area between edges B2 and B3) as the target area for printing. Carrier 45 is swept across the media sheet 35 from position 45A to position 45B, as shown in FIG. 7, to make a second swath adjacent the first swath to print a second set of reference marks 140 over the area between edges B2 and B3 at 225. In this example, the second set of reference marks are similar in pattern with respect to the first set of reference marks but include blocks 145 that are relatively light in darkness and/or composed of multiple thin lines. As can be seen, some blocks of the second set of reference marks 140 are printed over the previously created smear marks 125 while the others are printed over the unsmeared portions of the same area between edges B2 and B3.

Figure 8:
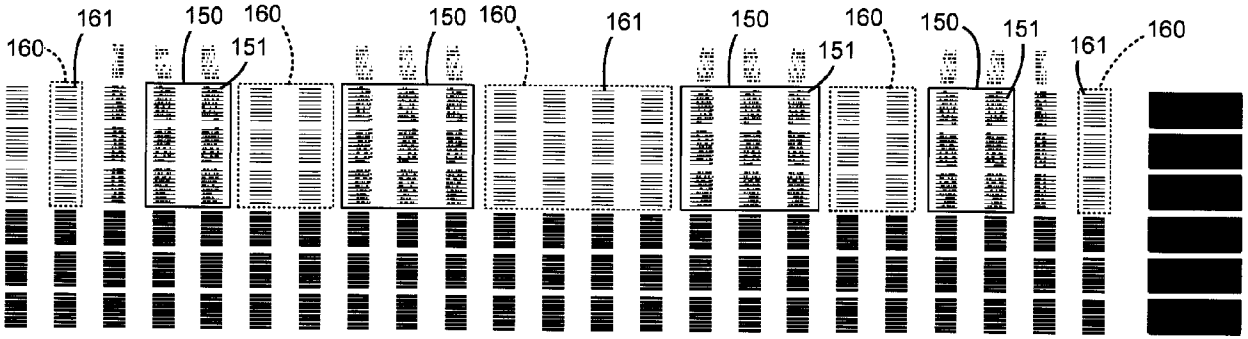
FIG. 8 is a diagrammatic view in accordance with the present invention of a representative printed pattern used in FIGS. 3-7 for ink smear measurement.

Next, at 230, sensor 60 is used to observe the second set of reference marks 140. Media sheet 35 is moved to a proper position adjacent carrier 45 within the field of view coverage of sensor 60 for observing the rows of the second set of reference marks 140. Carrier 45 is moved across the media sheet 35, allowing sensor 60 to read the blocks created on the second swath. In cases where the view of sensor 60 only covers a single block 145, carrier 45 may have to be swept across media sheet 35 several times, along with proper indexing of media sheet 35, in order to read each row of blocks 145. In one aspect, sensor 60 may read each of the blocks and provide signals associated thereto to controller 40. In another aspect, sensor 60 may read only selected and/or predetermined blocks 145 from the second set of reference marks 140. For example, as shown in FIG. 8, information associated with block sets 150 and 160 are used by controller 40 in calculating a smear score associated with media sheet 35. Block sets 150 include smeared blocks 151 while block sets 160 include clean blocks 161 having no smear marks.

Figure 9B:
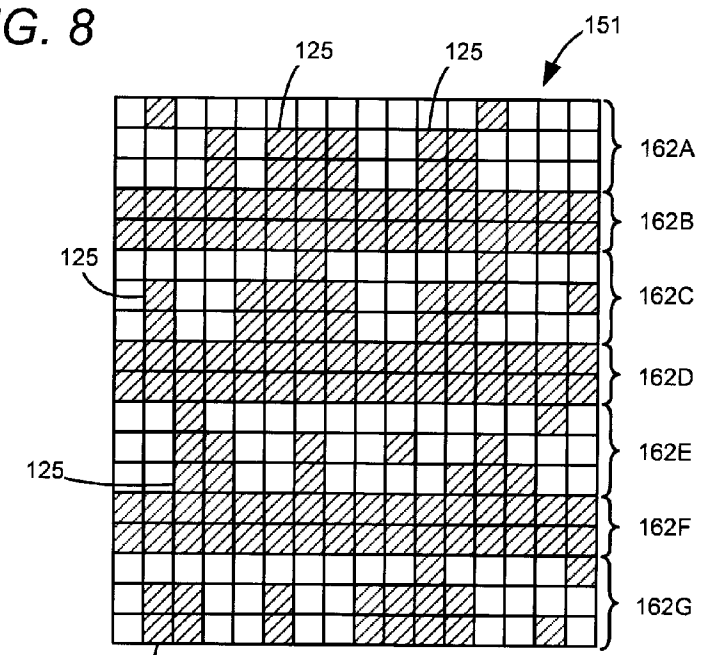
FIGS. 9A and 9B are diagrammatic views in accordance with the present invention of detailed portions of printed blocks of FIG. 8.
Figure 9A:
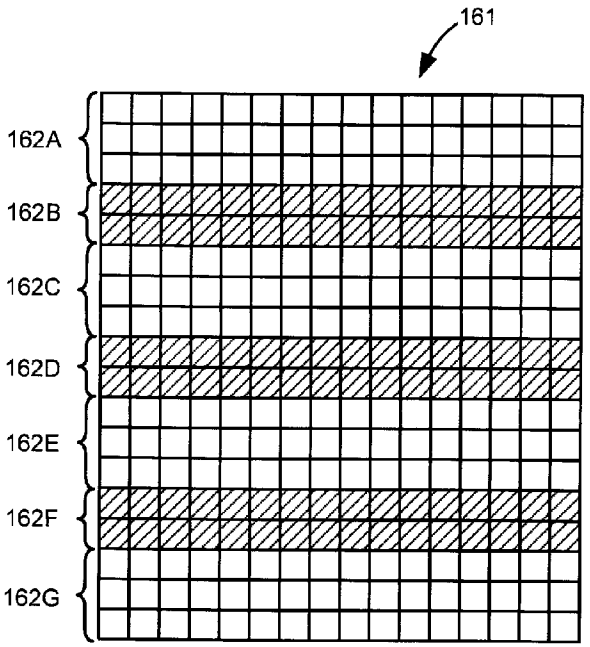

As an example, consider the image in FIG. 9A showing a portion of a clean block 161. In a variety of print rows 162, print rows 162B, 162D, and 162F are dark corresponding to printed thin lines of a light block 145, and print rows 162A, 162C, 162E, and 162G are absent of ink due to no smearing in the region of clean block 161. In FIG. 9B, a portion of a smeared block 151 is shown having dark areas or dots at print rows 162A, 162C, 162E, and 162G, corresponding to smear marks 125 occurring between the thin lines of a light block 145. Normally, output of sensor 60 depends upon intensity of light reflected from the blocks 145 and will vary according to the type of block being read. In particular, when sensor 60 passes over a smeared block 151, sensor output is reduced compared to when sensor 60 passes over a clean block 161 due to additional absorption of light by smear marks 125 that appear between the thin lines of the smeared block 151. Accordingly, reflectance of each block 145 varies according to the amount of smear.

Sensor 60 generates information from reading various smeared blocks 151 and clean blocks 161, and provides them to controller 40 for analysis at 235. The smear score is then calculated at 240 by comparing smeared block intensity data with clean block intensity data obtained by controller 40 from sensor 60. Initially, raw data read by sensor 60 is converted to discrete digital values according to a defined resolution. For example, for an 8-bit resolution, data obtained from sensor 60 is encoded to one of 256 discrete values (0-255) that defines an intensity value, where a lower value is darker.

Appreciating certain ambiguities in data representation may exist due to effects of gap variation, it may be desirable to perform compensation for gap variation. More particularly, since sensor 60 senses intensity of light reflected, it is sometimes difficult to distinguish whether the sensed intensity variation is caused by the differences in darkness of the blocks 145 or due to gap variation. As such, to provide for more accurate data, compensation for gap variation is done in firmware. In this example, white areas between reference marks are used to normalize the raw signal from sensor 60. In particular, white "peaks" in the data corresponding to the white areas are normalized near a 255 discrete value and data between the white "peaks" corresponding to the blocks are adjusted using linear interpolation between the peaks. It will also be appreciated that other known techniques for compensating for gap variation can be utilized.

The obtained intensity values are then compared to a threshold value. The threshold value may correspond to a minimum data signal level that can be attributed to areas that can be considered as white areas between the blocks or on the media sheet. For intensity values of 0-255, a threshold value of about 200 is assumed (but it may be any other desired value). Each intensity value is thresholded about the threshold value to derive inverted intensity values. An inverted intensity value is determined by subtracting the original intensity value from the threshold value. For example, an intensity value of 20 (which corresponds to a darker area) would have an inverted intensity value of 200−20=180; an intensity value of 190 (which corresponds to a lighter area) would have an inverted intensity value of 200−190=10; and an intensity value of 230 (which may correspond to a white area) would have an inverted intensity value of 200−230=−30. Negative inverted intensity values are set to a discrete value of 0 such that all intensity values from 201 to 255 will have inverted intensity values of zero. Given that the threshold value has been defined as corresponding to the minimum signal level associated with white areas, it is apparent that intensity values ranging from 200-255 correspond to white areas on the media sheet. Accordingly, inverting the data and setting the inverted intensity values for values within the 200-255 range to zero removes unnecessary values pertaining to white areas so that what remains are data corresponding to the reference blocks, or at least the dots forming the blocks including those created by smearing. In addition, by inverting the original data, darker areas now have higher associated values compared to lighter areas (and other areas corresponding to white areas) which can make future mathematical computations easier and more intuitive. In the example above, it would be desirable to have a higher associated value for the darker area (inverted intensity value of 180) than to have an associated value of 20, and to have a lower associated value for the lighter area (inverted intensity value of 10), in order to obtain larger values used in computations, and accordingly cover a wider range of values associated with smear tendency. It shall be appreciated, however, that implementing the procedure without thresholding and data inversion is possible.

An integrated intensity value is then determined for each block 145 within block sets 150 and 160. For example, all inverted intensity values associated with a particular block are added to compute the block's integrated intensity value. Referring again to FIGS. 9A and 9B, for example, an integrated intensity value is determined for clean block 161 by detecting the average light reflected over the clean block 161. Multiple readings over the clean block 161 can be made and those readings summed to compute the integrated intensity value. Likewise, an integrated intensity value is determined for smeared block 151 in a similar manner. Accordingly, smeared blocks 151 will have larger integrated intensity values relative to those computed for the clean blocks 161 due to the additional presence of smear marks 125 between the thin lines. After all selected blocks 145 are considered, the integrated intensity values for the smeared blocks 151 are summed and the integrated intensity values for the clean blocks 161 are also summed. Controller 40 then calculates the smear score by taking the difference between the two sums. Accordingly, a higher smear score means more smear.

At 245, various print parameters, such as dry time, ink density, printing speed, and others are adjusted based on the smear score in order to minimize, if not eliminate, smearing in future printing operations using other media sheets of a similar type as the measured media sheet. For example, a correlation is made between the smear score and various print parameters to determine optimal settings for a desired print operation. As an example, the imaging device makes adjustments based on the smear score to compensate for slowly drying ink when users request for duplexing operations and/or need fast throughput. In another, the imaging device adjusts settings to allow production of high quality images at a corresponding throughput rate and keep printed outputs relatively free from smears. In still another, adjustments are made to optimize print settings, balancing print quality and throughput while ensuring relatively smear-free printed outputs. Ultimately, future sheets of print media having similar characteristics or properties to a tested media sheet are the beneficiaries of assessing the smear tendency of the tested media sheet.

In an alternative embodiment, the above procedure can be modified to determine an optimal dry time associated with a media sheet under measurement. In particular, a sequence of operations is performed including printing dark blocks, waiting differing amounts of time, smearing the dark blocks after each differing amount of time elapses, and measuring smear marks on the media sheet to determine an optimal dry time associated with the media sheet.

Figure 10:
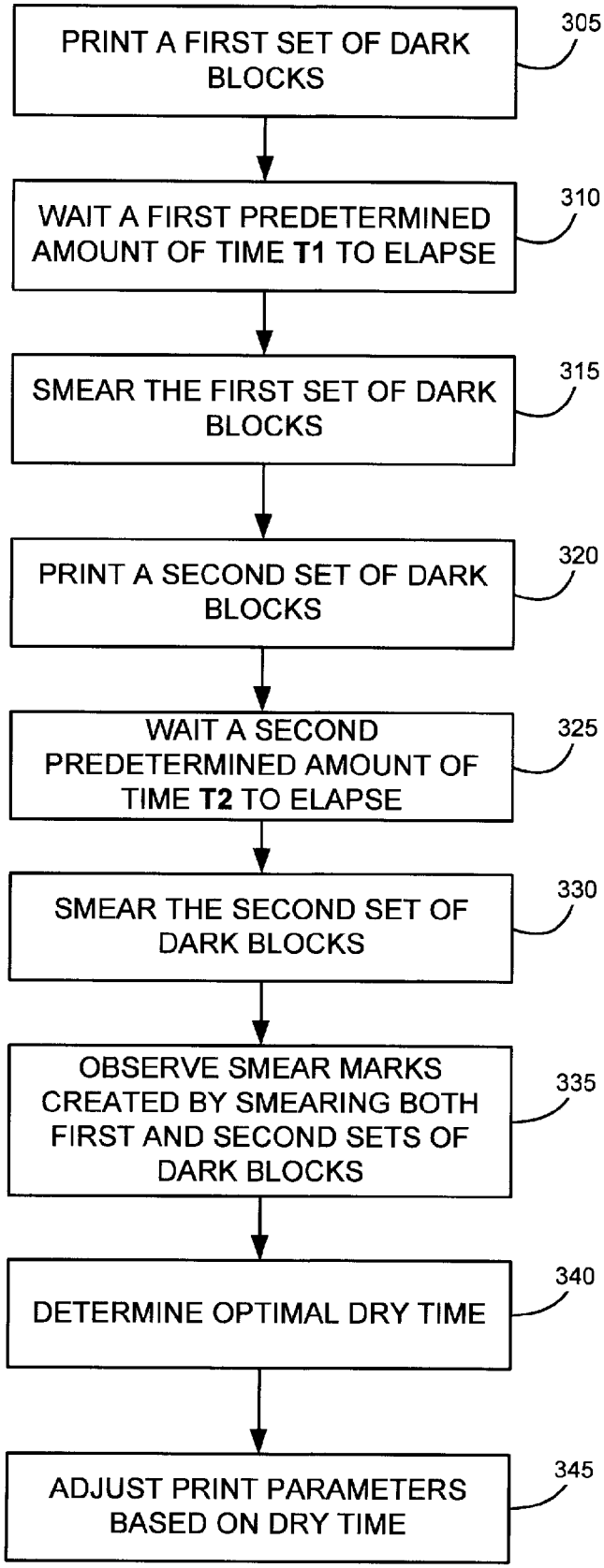
FIG. 10 is a flowchart in accordance with the present invention illustrating an example embodiment of determining optimal dry time using ink smear measurement.

FIG. 10 is a flowchart illustrating an example method of determining optimal dry time. At 305, a first set of dark blocks are printed on the media sheet. At 310, a first predetermined amount of time T1 is waited to elapse. The first predetermined amount of time T1 defines a first time period in which ink is allowed to partially dry to a point that would still allow smearing when contacted. At 315, the first set of dark blocks are smeared once time T1 has elapsed. At 320, a second set of dark blocks are printed on the media sheet. At 325, a second predetermined amount of time T2 different from the first predetermined amount of time T1 is waited to elapse. Like the first predetermined amount of time T 1, the second predetermined amount of time T2 defines a second time period in which ink is allowed to partially dry. At 330, the second set of dark blocks are smeared once time T2 has elapsed. Given that the two sets of dark blocks are smeared after different delay times, it would be expected that smearing each set would create two sets of smear marks having different characteristics. For example, if time T1 is greater than time T2, then the first act of smearing will create fewer smear marks than the second as the former would have allowed a longer time for ink to dry and thus less ink transferred onto the roller surfaces. Accordingly, the longer the delay before smearing, the less smear marks would appear on the media sheet.

Figure 11:
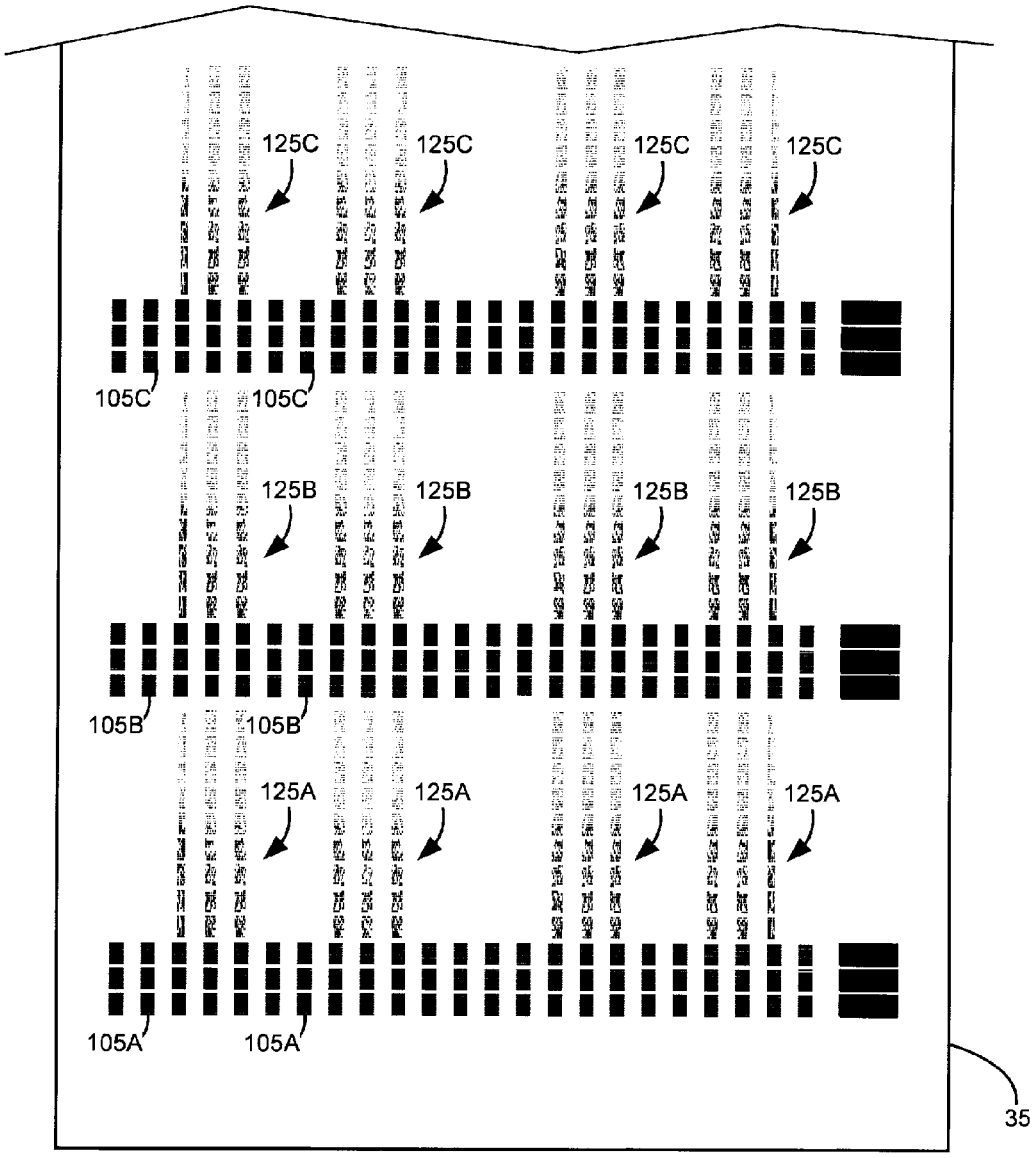
FIG. 11 is a diagrammatic view in accordance with the present invention of alternate embodiments of printed patterns.

It will also be appreciated that the foregoing described processes of printing dark blocks, waiting differing amounts of time, and smearing the blocks can be performed in an iterative fashion. For instance, it is contemplated that a third set of blocks can be printed and smeared after a time interval T3, a fourth set of blocks can be printed and smeared after a time interval T4, and so on. Further, the same pattern as before can be printed such that sets of dark blocks 105 are printed at different swaths separated by distances defined by areas where smear marks 125 are expected to appear, as shown for example in FIG. 11. In this example, smear marks 125A are created from smearing blocks 105A after a time interval T1 has elapsed after printing blocks 105A. Likewise, smear marks 125B and 125C are created from smearing blocks 105B and 105C after time intervals T2 and T3 have elapsed after printing blocks 105B and 105C, respectively. Of course, other arrangements of patterns are also possible.

At 335, the smear marks created by smearing both first and second set of dark blocks are observed using sensor 60. This can be done by using the methods described above (i.e., printing light blocks over smeared and unsmeared areas, and comparing them). Ultimately, a smear score is determined for each set of smear marks created by smearing each set of dark blocks. Alternatively, the smear marks can be observed immediately after their creation. For example, once smear marks are created from a set of dark blocks, they can be immediately observed before proceeding to printing and smearing a subsequent set of dark blocks. In still other embodiments, the operations of printing, smearing and observing may occur during the periods of waiting for the different time intervals to elapse.

Noting the difference between delay times T1 and T2 and the respective smear scores associated with each, an optimal dry time for the media sheet is determined at 340. For example, the smear score values and respective delay times are correlated and interpolated to determine the optimal dry time. At 345, the determined optimal dry time is then used to adjust printing parameters so that enough time may be provided for printed ink to dry to a sufficient point so that they do not smear or smudge when contacted by other surfaces. For example, when a first printed media is disposed on a media output area after a printing operation, the imaging device makes adjustments based on the optimal dry time so that a subsequent printed media is disposed on top of the first media just in time after ink on the first media has dried. In another example, for a duplex printing operation, the imaging device may be adjusted to wait for a determined time interval based on the optimal dry time so that media is not brought back into the imaging device while ink on the first page is not yet dry.

Other additional embodiments of the present invention are also possible without departing from the teachings herein. For example, the pattern of the reference marks, the number of blocks provided in a given column or row, spacing between the blocks, orientation of the lines comprising the blocks, the shape or pattern of the blocks, arrangement of the blocks, and/or other combinations, may vary depending upon the use contemplated. In addition, the patterns may need to be printed in the direction of paper travel rather than across the page. Furthermore, smear marks can be created at areas other than the areas discussed above, such as at the opposite side of the dark blocks. In such a case, the reference marks may need to be printed at an intermediate portion of the media sheet to allow space between the reference marks and the leading edge of the media sheet for smear marks to be created as the media sheet is further moved in the reverse direction after the pressure rollers contact the reference marks.

Figure 12:
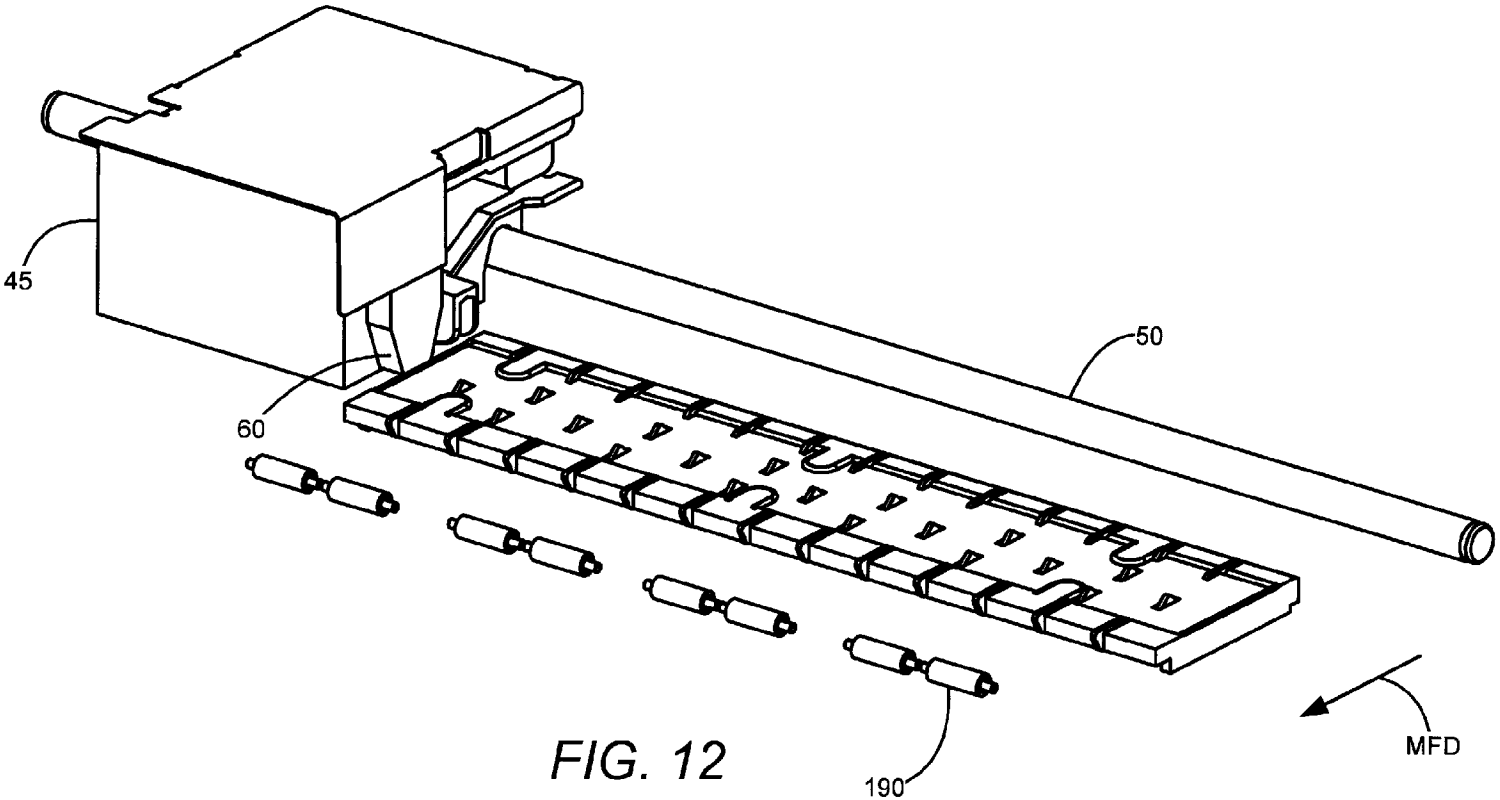
FIG. 12 is a perspective view in accordance with the present invention of an alternative embodiment showing a dedicated roller for smearing indicia on a media sheet.

A separate roller can be included in the imaging device that is solely dedicated to smearing and would not otherwise be used, such as downstream roller 190 shown, for example, in FIG. 12. Dedicated roller 190 is positioned adjacent the media path and is configured to engage a media sheet only during the smearing routines described above. Alternatively, such dedicated roller 190 can be positioned elsewhere along the media path.

Other types of reflective sensors or any suitable sensor, whether analog or digital, and other sensor arrangements can be utilized so long as such sensors are capable of sensing printed marks on media. For example, a sensor for measurement may need to be stationary when reading patterns. In such a case, such sensor can be moved by a motor to a fixed location at which marks are present on the media sheet such that the marks on the media sheet will move underneath the sensor as the media is fed between the pressure rollers and the feedroller and moved along the media path. This particular arrangement can be used, for example, in other embodiments contemplating use of page wide printhead arrays.

The application of the present invention also goes beyond standard inkjet printers and can apply to many inkjet systems. For example, in a continuous feed inkjet system, variation from roll to roll would be expected just as there is variation in smear tendency between lot numbers of the same type of recording media. Accordingly, a simple smear check could be performed every time a paper supply roll is replaced. For example, a sacrificial portion of a new media roll could be printed on with the patterns used above. With the smear tendency of the roll known, printing speed and ink density can be adjusted to minimize smear from any downstream rollers or a user handling at the output.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A method for determining smear tendency of a sheet of print media to reduce smearing on future media sheets of a similar type, comprising:

creating an image on the sheet of print media;

reversing the sheet of print media to allow at least one upstream roller to contact and smear the image and create smear marks on the sheet of print media;

creating reference marks over the smear marks and at unsmeared areas of the sheet of print media; and comparing the reference marks over the smear marks to the reference marks at the unsmeared areas to determine the smear tendency of the sheet of print media, the smear tendency indicating future corrections to an imaging device to reduce the smearing on the future media sheets when used by the imaging device.

2. The method of claim 1, wherein the reversing the sheet of print media allows the at least one upstream roller to smear only portions of the image and not all.

3. The method of claim 1, wherein the creating the image includes printing a plurality of substantially dark blocks arranged in a number of rows and columns, each dark block having unprinted portions therein.

4. The method of claim 1, wherein the creating the reference marks include printing a plurality of blocks over the smear marks and at the unsmeared areas, the comparing including determining reflectances of each block of the plurality of blocks using a sensor, and comparing the reflectances of the blocks created over the smear marks to the reflectances of the blocks created at the unsmeared areas.

5. The method of claim 1, wherein after determining the smear tendency and when printing on the future media sheets of a similar type, correcting at least one of dry time, ink density, and printing speed of the imaging device based on the smear tendency.

* * * * *